US008430106B2

(12) United States Patent
Potter et al.

(10) Patent No.: US 8,430,106 B2
(45) Date of Patent: Apr. 30, 2013

(54) VOLATILIZATION DEVICE

(75) Inventors: Dennis Potter, Tokyo (JP); Chuan Liu, Southampton (GB)

(73) Assignees: British American Tobacco (Investments) Limited, London (GB); R.J. Reynolds Tobacco Company, Winston-Salem, NC (US)

( * ) Notice: Subject to any disclaimer, the term of this patent is extended or adjusted under 35 U.S.C. 154(b) by 838 days.

(21) Appl. No.: 12/375,909

(22) PCT Filed: Aug. 2, 2007

(86) PCT No.: PCT/GB2007/002939

§ 371 (c)(1), (2), (4) Date: Nov. 13, 2009

(87) PCT Pub. No.: WO2008/015441

PCT Pub. Date: Feb. 7, 2008

(65) Prior Publication Data

US 2010/0059070 A1 Mar. 11, 2010

(30) Foreign Application Priority Data

Aug. 3, 2006 (JP) ..... 2006-211885

(51) Int. Cl.

| | |
|---|---|
| *A24F 1/22* | (2006.01) |
| *A24F 1/32* | (2006.01) |
| *A24F 13/04* | (2006.01) |

(52) U.S. Cl.
USPC ..... 131/194; 131/329; 131/359; 131/369

(58) Field of Classification Search ..... None
See application file for complete search history.

(56) References Cited

FOREIGN PATENT DOCUMENTS

| | | |
|---|---|---|
| CN | 1607911 A | 4/2005 |
| CN | 1787753 A | 6/2006 |
| EP | 0430559 A2 | 5/1991 |

OTHER PUBLICATIONS

Office Action, related Cn patent application no. 200780028999.9, dated Sep. 18, 2009.

*Primary Examiner* — Richard Crispino
*Assistant Examiner* — Phu Nguyen
(74) *Attorney, Agent, or Firm* — N W Poulsen

(57) ABSTRACT

A device for delivering volatilized material to a user comprises a heat delivery component (11), which includes a heat sink (14) in heat transfer relationship with a heat transfer device such a s a heat pipe (36), and a volatilization component (20), which includes a source (22) of volatilizable material, such as tobacco, a flavour material or a therapeutic substance. The volatilization component (20) is detachably mounted on the heat delivery component (11) with the source of volatilizable material (22) in heat transfer communication with the heat transfer device (36) of the heat delivery component. The heat delivery component (11) may therefore be reused with a series of disposable volatilization components (20).

17 Claims, 4 Drawing Sheets

VOLATILIZATION DEVICE

CLAIM FOR PRIORITY

This application is a National Stage Entry entitled to and hereby claims priority under 35 U.S.C. §§365 and 371 corresponding to PCT Application No. PCT/GB2007/002939, titled, "VOLATILIZATION DEVICE," filed Aug. 2, 2007, which in turn claimed priority to JP Application Ser. No. 2006-211885, filed Aug. 3, 2006, all of which are hereby incorporated by reference.

BACKGROUND OF THE INVENTION

The present invention relates to volatilization devices.

Devices for delivering volatilized material to users have several uses, in particular as smoking simulation devices, or for the delivery of flavourants or therapeutic substances to the user.

Various proposals have been made to develop smoking simulation devices which provide tobacco smoke taste without the combustion of tobacco. These include, for example, U.S. Pat. No. 5,944,025 issued to Cook et al. which teaches a simulated cigarette wherein hot gases are generated in a catalytic section of the smoking article which are used to form volatilized flavorable aerosol gases which are then delivered to a smoker's mouth while controlling the composition of the gases of combustion and U.S. Pat. No. 4,892,109 issued to Strubel teaches a simulated smoking article which utilizes chemical reactants which exothennically react when mixed to provide a heat source for heating aerosol generating substances which are drawn into the mouth of a smoker. U.S. Pat. No. 5,247,947 issued to Clearman et al,: U.S. Pat. No. 4,819,665 issued to Roberts et al. and U.S. Pat. No. 4,793,365 issued to Sensabaugh Jr. et al. all teach various simulated cigarettes or smoking articles wherein a heated aerosol is produced from a carbonaceous external heat source and then delivered to a smoker. Moreover, U.S. Pat. No. 6,532,965 issued to Abhulimen et al. teaches a non-combustible simulated smoking article which uses steam as an aerosol-generating source.

A device for delivering a volatilized therapeutic material is disclosed in U.S. Pat. No. 4,917,119, issued to Potter et al. The device is in the form of a tube through which the user inhales. A substrate carrying a drug at the core of the tube is surrounded by an annular charge of a material that generates heat on contact with water, such as calcium oxide. When the heat source is triggered, the heat produced volatilizes the drug, which the user inhales through the tube. The device is used once only, and is then discarded.

SUMMARY OF THE INVENTION

Broadly in accordance with the present invention there is provided a device for delivering volatilized material to a user comprising a heat sink, a heat transfer device in heat transfer relation with the heat sink and a volatilization component comprising a source of volatilizable material in detachable heat transfer communication with the heat transfer device.

By providing a volatilization device that is detachable from the heat transfer device, the volatilization devices can be made and sold separately from the heat transfer device, and the heat transfer device can be re-used.

In order to facilitate detachment of the volatilization component, the device is preferably constructed of two basic components that can be easily separated by the user. One of the components incorporates the volatilization component, possibly together with the heat sink or the heat transfer device, and the other component incorporates either the heat sink or the heat transfer device, or both. For example, in one embodiment of the invention, the heat sink and the heat transfer device are mounted together in a first component of the device, and the source of volatilizable material is mounted in a second component of the device, the second component being separable from the first component. In an alternative construction, the heat sink and the volatilization component are mounted in a first component of the device, and the heat transfer device is mounted in a second component of the device.

Conveniently the heat sink and the heat transfer device are mounted on the same component of the device. Accordingly, the present invention specifically provides a device for delivering volatilized material to a user comprising: a heat delivery component comprising a heat sink and a heat transfer device in heat transfer relation with the heat sink; and a volatilization component comprising a source of volatilizable material in detachable heat transfer communication with the heat transfer device of the first component.

The invention also includes a heat delivery component for use in a device according to the invention comprising a heat sink in heat transfer relation with a heat transfer device, the component being adapted to support a detachable source of volatilizable material in heat transfer communication with said heat transfer device.

The invention further includes a volatilization component for use in a device according to the invention comprising a mouthpiece and a source of volatilizable material adjacent to the mouthpiece and adapted to engage in heat transfer relationship with the heat transfer device.

If desired, the volatilization component of the device may include a filter section through which volatilized material passes.

The heat delivery components of the invention are preferably reusable, and the volatilization devices of the invention are preferably disposable, or usable only once.

The heat delivery component and the volatilization component are detachably connected together. For this purpose, the source of volatilizable material and the heat transfer device are preferably in heat transfer communication through portions that are complementary in shape. For example, the source of volatilizable material preferably includes a channel or recess that is complementary in shape to, and detachably engages, one end of the heat transfer device. The adjacent ends of the said components may conveniently be complementary in shape, the end of one component being detachably received within the other.

In one embodiment the volatilizable material is mounted on a carrier or support adapted to engage the heat transfer device and having heat transfer surfaces for transferring heat from the heat transfer device into the volatilizable material.

The device and components of the invention may be used to deliver any volatilizable material to a user, including flavours, and therapeutic materials. Preferably however the invention is used to provide a non-combustible simulated cigarette. In these embodiments of the invention, the source of volatilizable material comprises tobacco or a tobacco substitute.

The heat delivery component comprises a heat sink from which heat is transferred by a heat transfer device for communication to a source of volatilizable material.

The heat sink is preferably in the form of a body of heat absorbing material, arranged to be heated from an external heat source, capable of absorbing and retaining sufficient applied heat to enable the applied heat to be transferred away by the heat transfer device to the source of volatilizable material over a period of time in a controlled way to generate the release of the volatilizable material to the use over a required period.

The external heat source may be an open flame, or an initial heating device, for example an electrical resistance heating device, which may include a device designed to produce a specified temperature through means of a thermostatic control. A thermo-chromic heat indicating device may be included at the heat sink end of the heat delivery component in order to give a visible indication to the user that the device has reached its working temperature.

Any suitable material may be used as the heat sink. For example, the heat sink may be of metal, such as stainless steel, or a ceramic material. It may comprise a material of high heat capacity, or a material capable of absorbing and then releasing heat via a reversible process involving the heat of formation, for example by a high temperature phase change.

The heat transfer device may be in the form of a simple heat conducting element, for example a solid or tubular rod of a conductive metal such as copper. Preferably however, the heat transfer device is in the form of a heat pipe. Such devices conventionally comprise a metal tube filled with a heat conductive liquid that efficiently conducts heat along the tube. Such products are available from Enertron, Inc. of Chandler, Ariz., U.S.A., and others. A single, or multiple, conducting elements or heat pipes may be used, or one or more heat pipes may be used in conjunction with one or more of the conducting elements.

In order to reduce heat loss during heat transfer, the heat transfer element may be insulated between the heat sink and the source of volatilizable material.

Preferably, air enters the device at one or more points between the heat sink and the source of volatilizable material as the user draws upon the device. The air is preferably heated by heat from the heat sink and then passes through the source of volatilizable material so that volatilized material is released to travel through the device to the user.

In the preferred embodiment of the invention, the heat delivery component comprises a longitudinally-extending outer tube or wrap circumscribing the heat sink and the heat pipe. The tube may be made, for example, of a high heat resistant plastics material, of which numerous are commercially available, for example polytetrafluorethylene (PTFE), perfluoroalkoxyethylene (PFA) or a linear aromatic thermoplastic polymer such as that sold by Victrex plc under the trade mark PEEK, any version of which may be unfilled or may contain a filler material such as 30% by weight of glass. The outer tube includes a plurality of ventilation holes towards the end adjacent the volatilization component.

The end of the heat transfer device that is in heat transfer communication with the volatilization component may incorporate a coating suitable for contact with the source of volatilizable material. Suitable coatings may include aluminium, stainless steel, high temperature plastics, or heat conductive ceramics. Further, the end of the heat transfer device may be formed into or incorporate heat conductive geometric shapes, such as fins, grooves, ridges or plates, forming heat transfer surfaces that improve contact and heat conduction to the source of volatilizable material.

BRIEF DESCRIPTION OF THE DRAWINGS

In order that the invention may be better understood particular embodiments thereof will now be described, by way of example only, with reference to the accompanying drawings, wherein like numerals refer to like parts throughout the views, and in which.

DETAILED DESCRIPTION

Figure 1:
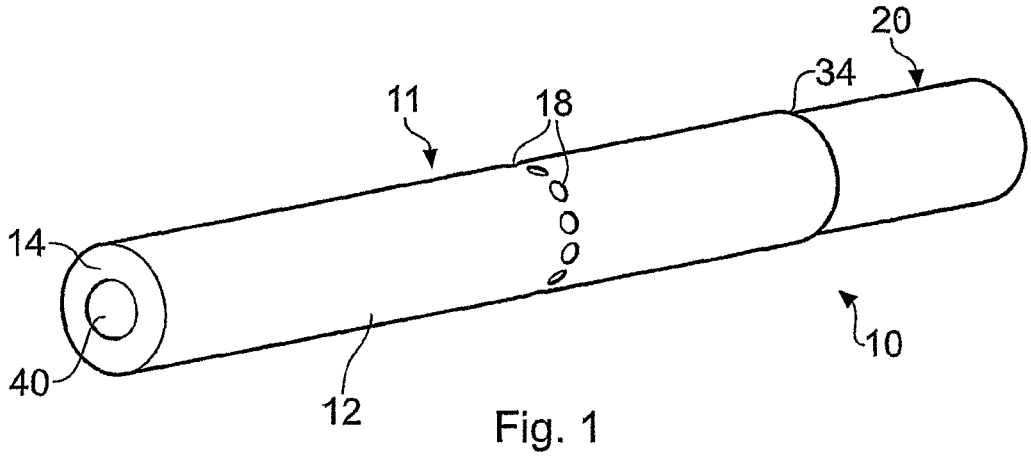
FIG. 1 is a perspective view of a first device in accordance with the present invention in an assembled condition.
Figure 2:
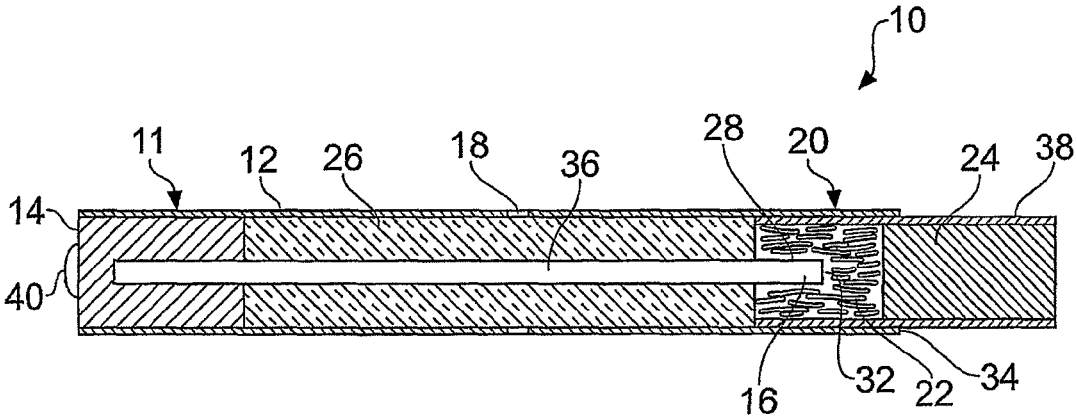
FIG. 2 is a longitudinal cross-sectional view of the device FIG. 1.
Figure 3:
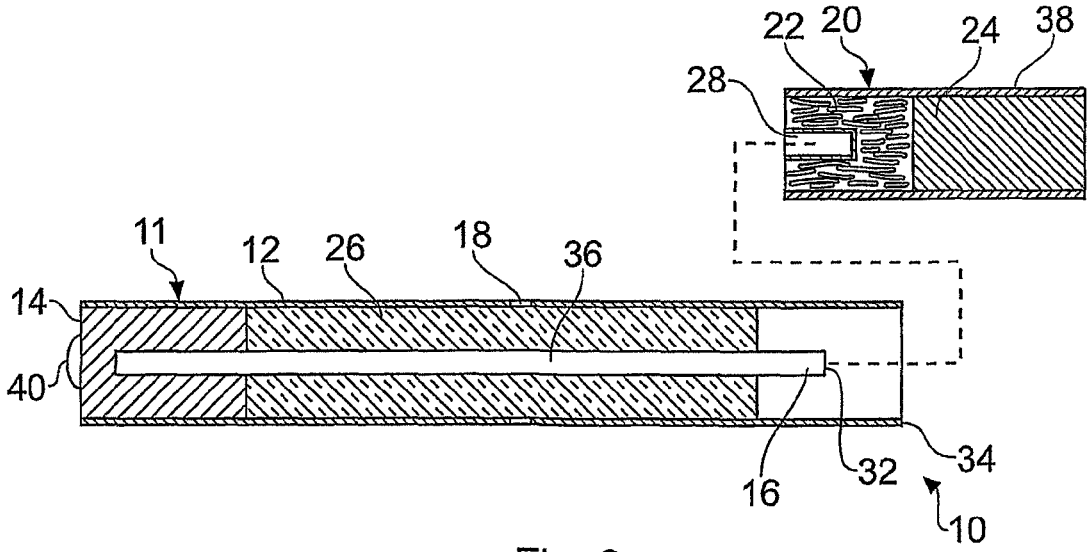
FIG. 3 is a longitudinal cross-sectional view of the device of FIGS. 1 and 2 in a disassembled condition.

With reference to FIGS. 1, 2, and 3 there is shown a device 10 for delivering volatilized material to a user in the form of a simulated cigarette, which includes a heat delivery component 11, which is reusable, and a volatilization component 20, which is usable once only and is intended to be disposed of after use. The heat delivery component 11 includes a cylindrical housing or outer wrap 12, which is a non-heat conducting tube composed, for example, of a high heat resistant plastics material, ceramic or other durable material with low heat conductivity. Disposed within the wrap 12 is a heat transfer device, in the form of a heat pipe 16 circumscribed by supporting and insulating material 26. The heat pipe 16 extends longitudinally into a heat sink 14 at one end, and at an opposed end extends into the volatilization component 20, which is disposable.

Although the embodiment of the device of the invention illustrated herein is shown as a simulated cigarette, it can also be designed to simulate other smoking articles such as a cigar or a pipe. Additionally, while the heat pipe 16 is illustrated as a linear element in the embodiment described, it will be clear to those skilled in the art that the heat pipe 16 can be formed into different, non-linear, configurations. For examp1e the heat sink 14 could be laterally offset from the volatilization component 20.

The outer wrap 12 is provided with a plurality of perforations 18 therearound at one location or more, usually from about 5 mm to 20 mm from the terminating second end 32 of the heat pipe 16. The number and size of the perforations 18 control the resistance and amount of airflow through the supporting and insulating material 26 of the device 10 when in use. The terminating end of the outer wrap 12 is flared slightly, to accommodate the disposable volatilization component 20 upon insertion into the terminating end and detachment therefrom.

The heat sink 14 collects and retains heat that is supplied from an outside source. Heat sink 14 is generally an appropriate metal or ceramic material such as thermo store honeycomb ceramics, aluminium, or foamed aluminium, or may utilize an encapsulated or closed cell structure containing a phase change material selected to operate within a desired optimum heat range, thereby extending heat retention capacity through physical phase change between a high energy state such as a liquid, to a low energy state such as a solid. Numerous phase change materials with melting points between 150 and 250° C. are available, having latent heats of fusion in the range 100-700 J/cc, including salts, such as $AgNO_3$, $AlCl_3$, $TaCl_3$, $InCl_3$, $SnCl_2$, $AlI_3$, and $TiI_4$; metals and metal alloys such as selenium, tin, indium, tin-zinc, indium-zinc, or indium-bismuth; and organic compounds such as D-mannitol, succinic acid, p-nitrobenzoic acid, hydroquinone and adipic acid. One particularly suitable phase change material is a eutectic of tin (91 wt %) and zinc (9 wt %), which has a melting point of 199° C. Alternatively, materials capable of undergoing reversible heat producing processes may also be utilized in the heat sink 14. These include, for example, magnesium hydride which, when heated results in a disassociation of the hydrogen from the magnesium; upon cooling, the hydrogen and magnesium join chemically to form magnesium hydride thereby releasing heat in the process of returning to the lower energy state of magnesium hydride. Alternatively other high temperature phase change materials (that is materials undergoing a phase change of from about 150° C. to about 300° C.) can be used.

Preferably, the heat sink 14 is from 15 mm to 30 mm in length and is approximately the circumference of a standard cigarette, which is about 25 mm. The heat sink 14 should be of a material that can preferably be heated to between 200° F. and 600° F. (from about 90° C. to about 315° C.) and more preferably between 300° F. and 500° F. (from about 148° C. to about 260° C.). Further, the heat sink 14 may be jacketed by a thin insulating material (not shown) that has low conductive heat transfer capacity, which allows the heat sink to receive heat from a direct flame but provides a layer of insulation to the user from direct contact with the heated heat sink. The insulating jacket may also be a movable jacket that may slide down the device 10 to expose the heat sink for heating and slide up the device 10 to cover the heat sink 14, providing both direct contact protection for the user and added insulation of the stored heat. Moreover, in heat relation with the heat sink 14 or the insulating jacket (not shown), a thermo-chromatic indicator may be employed on the surface thereof as indicated, for example, by the numeral 40, and may be used to provide an indication to the user when the end of the device 10 is sufficiently heated to the functional heat range for use. Thermo-chromatic materials usable as indicators include, for example, zinc oxide, lead (II) oxide, nickel sulfate, chromium-rich pyropes, and the like. Alternatively a mechanical device incorporating a bi-metallic thermostat could be incorporated in the heat sink 14 or insulating jacket (not shown) to provide visual confirmation that the appropriate functional heat range has been reached.

As best shown in FIGS. 2 and 3, the reusable heat delivery component 11 of the device 10 also includes a heat transfer device in the form of a heat pipe 16, which has one end 30 in heat transfer relationship with the heat sink 14 and an opposed end 32 which is received within a section 22 of the volatilization component that contains a source of volatilizable material, in this case a composition containing tobacco. The heat pipe 16 is generally a hollow metal tube, for example monel, titanium, aluminium or copper tube sealed at both ends and filled with a heat transfer material 36. Preferably, the heat transfer material 36 comprises a capillary wicking material that is saturated with liquid such as, for example, water, and is designed to transfer the heat energy from the heat sink 14 to the tobacco section 22. For example, copper jacketed water heat pipes having an operating temperature range of from 5° C. to 230° C. or monel jacketed water heat pipes having an operating temperature range of from 5° C. to 290° C. are sufficient for use in the instant invention. Moreover, the heat pipe 16 is generally from about 2 mm to 6 mm in diameter and from 5 cm to 9 cm in length. The heat pipe 16 is surrounded by an appropriate supporting and insulating material 26 such as, for example, ceramic mat, ceramic fibers, porous ceramic, glass fiber, open cell resin foam, or other suitable insulating material capable of repeated exposure to the functional heat range. The exposed end 32 of heat pipe 16 is adapted to engage in heat transfer communication with the tobacco section 22, as discussed hereafter. The exposed end 32 may incorporate a coating suitable for contact with the tobacco section 22. Suitable coatings may include aluminium, stainless steel, high temperature plastics, or heat conductive ceramics. The supporting and insulating material 26 covers the heat pipe 16 from the heat sink 14 to within usually 5 mm to 10 mm of the second or exposed end 32 of the heat pipe.

As best shown in FIG. 3, the non-combustible smoking device 10 includes a disposable volatilization component 20 which includes the tobacco-based source of volatilizable material 22 and also in this embodiment a filter section 24 in axial alignment with the tobacco section 22. The tobacco section 22 is provided with a channel section or recess 28 having an inside diameter approximately the same as the outside diameter of the end 32 of the heat pipe 16, making it complementary in shape and adapted to receive the heat pipe end 32. The tobacco section 22 is generally of cylindrical shape of about 5 mm to 20 mm in length and is wrapped in paper or other appropriate material, as indicated by the numeral 38, with an outside diameter substantially equal to the inside diameter of the outer wrap 12. Thus, the tobacco section 22 is adapted to slide into the outer wrap 12 of the heat delivery component 11 as the heat pipe end 32 slides into the channel 28 in order to effect transfer of the heat energy therein. A ring of perforations (not shown) similar to those shown at 18 in FIG. 1 may be provided in the cylindrical housing of the tobacco section 22 to facilitate volatilization and air flow through the device.

Figure 4A:
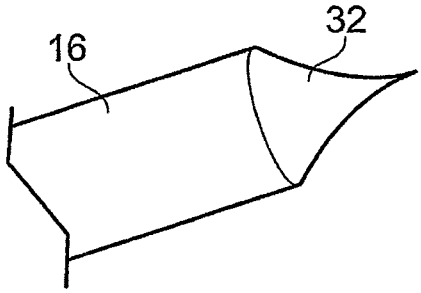
FIG. 4*a* is a perspective view, on an enlarged scale of part of an alternative device according to the invention.
Figure 4B:
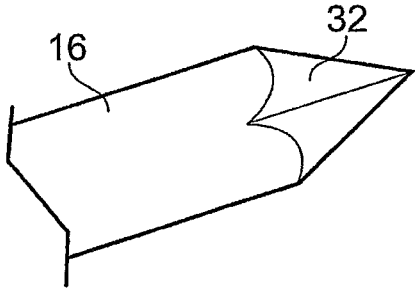
FIG. 4*b* is a similar view to FIG. 4*a* of another alternative device according to the invention.
Figure 4C:
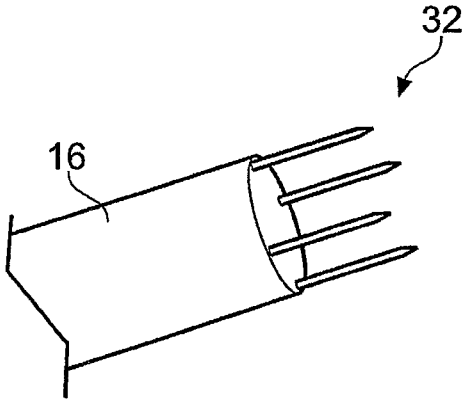
FIG. 4*c* is a similar view to FIG. 4*a* of yet another alternative device according to the invention.

As shown in FIG. 3, heat pipe end 32 may be flat or even slightly rounded. Alternatively, heat pipe end 32 may be geometrically shaped so as to actually penetrate the tobacco section 22 to improve contact and heat conduction thereto. With such an adaptation of the heat pipe, the section 22 may not require the channel section 28. FIG. 4*a* illustrates one such alternate embodiment of heat pipe end 32 configured in the shape of a single penetration needle. FIG. 4*b* illustrates another alternate embodiment of heat pipe end 32 configured in the shape of a cone with flat fins. FIG. 4*c* illustrates yet another alternative embodiment of heat pipe end 32 configured in the shape of multiple penetration needles. The tobacco. or flavor generating section 22 typically comprises tobacco particles, processed tobacco sheet, or extruded tobacco that has been appropriately selected, cased and flavored to function as a heat, but not burn, tobacco substrate.

A mouthpiece incorporating a filter end 24 is attached to the flavoring or tobacco substrate 22. The filter 24 is generally a cross-linked polypropylene web, or a high denier per filament cellulose acetate, or a shaped cellulose acetate tube or other material that provides appropriate firmness and low draft, low removal efficiency. The filter 24 is attached to the substrate by the outer paper wrap 38 or the like.

In use, the volatilization component 20 is inserted into the flared end 34 of the reusable heat delivery component 11 with the end 32 of the heat pipe 16 being received within the channel 28 of the tobacco or flavoring section 22. The heat sink 14 is then heated from an outside heat source, such as a cigarette lighter or the like, to a pre-selected temperature as preferably determined by a thermally triggered indicator such as thermio-chromatic indicator 40 or other such indicator. When the indicator reaches the pre-selected temperature, the smoker or user discontinues the heating process and draws on the mouth or filter end 24 of the volatilization component 20. Air passes into the supporting and insulation material 26 of the heat delivery component 11 through the air holes 18, and is heated by the heat disposed within the heat transfer pipe 16. The hot air then passes through the tobacco or flavoring section 22 which has also been heated through contact with the heat pipe 16, where it volatilizes the flavoring component disposed within section 22 and is then drawn into the mouth of the user.

Figure 5:
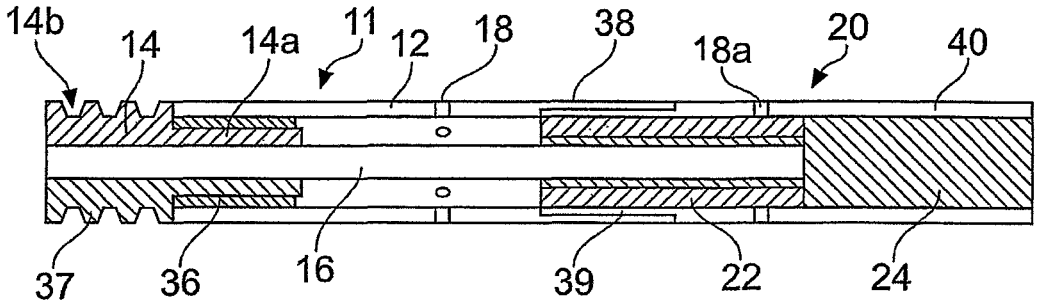
FIG. 5 is an axial cross-section of a second device in accordance with the invention, in assembled condition.

FIG. 5 illustrates a further embodiment of the invention comprising a heat delivery component 11 and a volatilization component 20. The heat delivery component 11 comprises a cylindrical housing 12 along the central axis of which lies a heat pipe 16. The heat pipe 16 is mounted at one end in a heat sink 14. One end of the heat sink 14 is in the form of a spigot 14*a* which is received in one end of the cylindrical housing 12. A layer of insulating material 36 lies between the housing 12 and the spigot 14*a*. The other end of the heat sink 14 projects from the housing 12 and is shaped to provide on its external surface a heat transfer region 14*b* which, in the embodiment illustrated, carries series of concentric ribs 37. The ribs 37 increase the surface area of the heat sink and facilitate the rate of heat transfer from an external source into the heat sink 14. It will be appreciated that alternative surface shapes may be provided on the heat sink to achieve effective heat transfer, for example fins or grooves. The other end of the housing 12 defines a socket 38, which receives a spigot 39 of complementary shape formed on the end of the volatilization component 20 of the device.

The volatilization component 20 comprises a filter section 24 and a flavour generating section 22 contained within a cylindrical housing 40 having the same external diameter as the housing 12 of the heat delivery component, except at one end, which is of reduced diameter to form the spigot 39. The housings 12, 40 of both the heat delivery component and the volatilization component are each provided with a ring of perforations 18, 18*a* allowing air to be drawn into the device in use.

Figure 6:
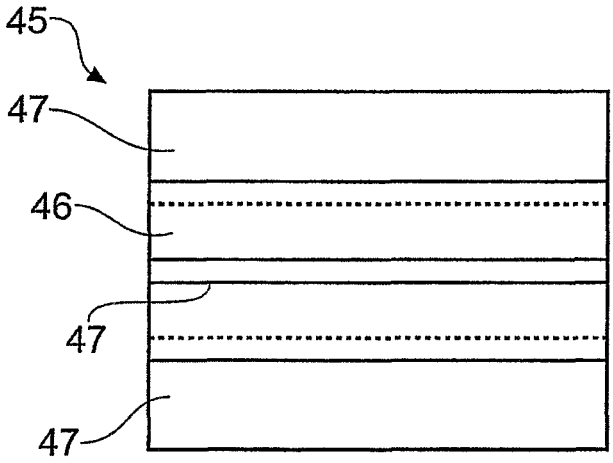
FIG. 6 is a side view of a volatilization component used in the device of FIG. 5
Figure 7:
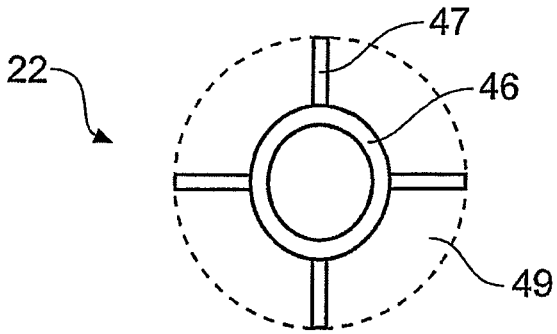
FIG. 7 is an end view of the volatilization component shown in FIG. 6.

As best seen in FIGS. 6 and 7, the flavour generating section 22 comprises a carrier 45 of heat conducting material, for example a metal such as copper or aluminium. The carrier 45 has a cylindrical central core 46, which is a sliding fit on the heat pipe 16, and four radial fins 47 on its external surface which extend axially along the carrier. Tobacco material 49 disposed between the four fins is shaped to provide a cylindrical outer surface which abuts the internal surface of the housing 40 of the volatilization component. The carrier 45 serves to transfer heat from the heat pipe to the tobacco material.

Figure 8:
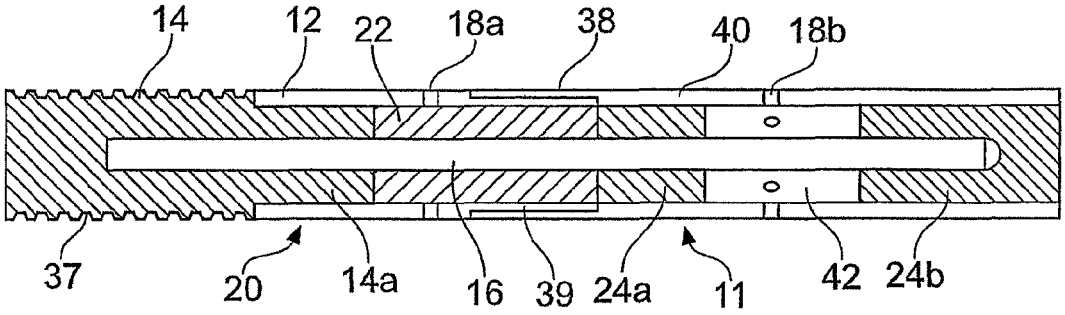
FIG. 8 is an axial cross-section of a third device in accordance with the invention.
Figure 9:
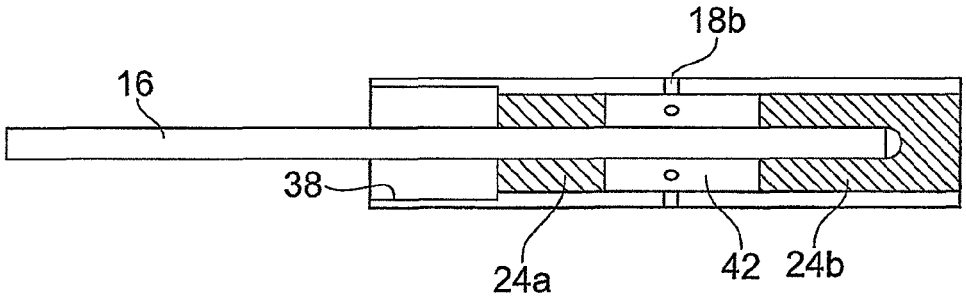
FIG. 9 is an axial cross-section of one component of the device shown in FIG. 8 when disassembled.

A further embodiment of the invention is illustrated in FIGS. 8 and 9. The device comprises a volatilization component 20 and a heat transfer component 11. The volatilization component 20 comprises a cylindrical housing 12, a heat sink 14 positioned in one end of the housing 12, and a cylindrical body of tobacco material 22 positioned in the other end of the housing 20 in contact with the heat sink 14. The body of material 22 may be constructed as shown in FIGS. 6 and 7. One end of the heat sink 14 is in the form of a spigot 14*a* which is received in the end of the cylindrical housing 12. The other end of the heat sink 14 projects from the housing 12 and is shaped to provide on its external surface a series of concentric ribs 37 which from a heat transfer region for facilitating the rate of heat transfer from an external source into the heat sink 14. The heat sink 14 and the body of tobacco material 22 have central passages aligned coaxially to receive one end of a heat pipe 16. The end of the housing 12 remote from the heat sink defines a spigot 39, which is a sliding fit with a socket 38 of complementary shape formed on one end of the heat transfer component 11 of the device. A ring of perforations 18*a* is formed in the housing 12 to allow air to be drawn into the housing in the region of the body of tobacco material.

The heat transfer component 11, as shown in FIG. 9, is detachable from the volatilization component 20. The heat transfer component 11 comprises a cylindrical housing 40 terminating at one end in the socket 38, and two filter sections 24*a* and 24*b*, one of which lies adjacent the socket 38, the other of which lies at the end of the housing 40 opposite the socket 38. The filter sections 24*a* and 24*b* are separated from each other by a void 42 which is in communication with the exterior of the housing 40 by a ring of perforations 18*b*. A heat pipe 16 is located at one end in a recess of the filter section 24*b* and extends along the central axis of the housing 40 through a central passage in the other filter section 24*a*. The heat pipe is sufficiently long that when the two components of the device are assembled, as shown in FIG. 8, the end of the heat pipe remote from the filter section is received within the central bore of the heat sink 14.

If desired, the filter section 24*b* at the end of the housing 40 may carry an additional flavourant which is released when the filter element is heated by the heat pipe 16.

In use, the user separates the volatilization component 20 from the heat transfer component 20, slides a body of tobacco material 22 on to the heat pipe 16, and re-assembles the device by inserting the end of the heat pipe 16 into the recess in the heat sink 14 and pushing the spigot 39 on the housing 12 of heat transfer component 20 into the socket 38 on the housing 40 of the heat transfer component 11. Heat is then applied to the heat sink 14. The heat travels along the heat pipe 16 causing the temperature of the tobacco material 22 and the air in the void 42 to increase. When the user draws on the end of the heat transfer component 11, air enters the device through the perforations 18*a* and 18*b*, and carries volatilized material into the user's mouth. After use, the device can be disassembled, and the used tobacco material discarded and replaced by fresh material.

It will also be noted that, in other embodiments, the devices of the invention can be used to deliver other volatilized materials to the user, such as therapeutic materials, for example, medicinal drugs. These embodiments of the invention will be similar in all respects to the devices shown in the accompanying drawings, except that the volatilization component 20 will include a volatilizable therapeutic material in section 22 rather than a flavoring or tobacco. Examples of such therapeutic materials will be found in U.S. Pat. No. 4,941,483 issued to Ridings et al. and U.S. Pat. No. 4,955,399 issued to Potter et al., which are hereby incorporated by reference.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

The invention claimed is:

1. A device for delivering volatilized material to a user comprising:

a heat delivery component comprising an elongate body having proximal and distal ends, and a heat sink;

a detachable volatilization component on the proximal end of the body, comprising a source of volatilizable material extending longitudinally of the body; and a heat pipe extending along and within the body and thermally coupled at one end to the heat sink, the heat pipe extending longitudinally into and in heat transfer communication with the volatizable material along a portion of the length of the heat pipe and the volatizable material.

2. The device according to claim 1 wherein the source of volatilizable material and the heat pipe are in heat transfer communication through portions that are complementary in shape.

3. The device according to claim 1 wherein source of volatilizable material includes a channel or recess that is complementary in shape to, and detachably engages, one end of the heat pipe.

4. The device according to claim 1 wherein adjacent ends of the said components are complementary in shape, and the end of one component is detachably received within the other.

5. The device according to claim 1 wherein the heat transfer pipe is insulated between the heat sink and the source of volatilizable material.

6. The device according to claim 1 wherein the heat sink comprises a material capable of producing heat via reversible a processes involving the heat of formation.

7. The device according to claim 1 wherein the heat sink comprises a high temperature phase change material.

8. The device according to claim 1 wherein the heat sink comprises magnesium hydride.

9. The device according to claim 1 wherein said heat sink comprises a ceramic material or a metal.

10. The device according to claim 9 wherein said heat sink comprises a thermo store honeycomb ceramic material, aluminium, or foamed aluminium.

11. The device according to claim 1 wherein said source of volatilizable material includes tobacco.

12. The device according to claim 1 wherein the source of volatilizable material includes a volatilizable therapeutic composition.

13. The device according to claim 1, wherein said volatilization component includes a filter section in through which volatilized material passes.

14. The device according to claim 1 wherein the heat delivery component comprises a longitudinally-extending outer wrap circumscribing the heat sink and the heat pipe.

15. The device according to claim 14 where in the outer wrap includes a plurality of ventilation holes towards the end of the outer wrap adjacent the volatilization component.

16. The device according to claim 1 further comprising a thermo-chromic heat indicating device at the heat sink end of the heat delivery component.

17. The device according to claim 1 wherein the source of volatilizable material is mounted on a support adapted to engage the heat transfer device and having heat transfer surfaces for transferring heat from the heat transfer device into the volatilizable material.

* * * * *

UNITED STATES PATENT AND TRADEMARK OFFICE

CERTIFICATE OF CORRECTION

PATENT NO. : 8,430,106 B2
APPLICATION NO. : 12/375909
DATED : April 30, 2013
INVENTOR(S) : Potter et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1092 days.

Signed and Sealed this
Sixth Day of January, 2015

Michelle K. Lee

Michelle K. Lee
*Deputy Director of the United States Patent and Trademark Office*